United States Patent [19]

Ducassou

[11] Patent Number: 4,904,199

[45] Date of Patent: Feb. 27, 1990

[54] SUPPORT FOR DETACHABLE JUNCTION BETWEEN CABLES

[75] Inventor: Francis L. Ducassou, Yerres, France

[73] Assignee: Treficable Pirelli, Saint Maurice, France

[21] Appl. No.: 297,696

[22] Filed: Jan. 17, 1989

[30] Foreign Application Priority Data

Jan. 22, 1988 [FR] France ..... 8800675

[51] Int. Cl.[4] ..... H01R 13/46

[52] U.S. Cl. ..... 439/304; 439/367; 439/368; 439/527; 439/489

[58] Field of Search ..... 439/304, 367–369, 439/477, 527, 533, 540, 576, 892, 488, 489

[56] References Cited

U.S. PATENT DOCUMENTS 3,422,281 1/1969 Coston ..... 439/367 X 4,749,363 6/1988 Luska et al. ..... 439/367

*Primary Examiner*—Steven C. Bishop

*Attorney, Agent, or Firm*—Brooks, Haidt, Haffner & Delahunty

[57] ABSTRACT

The invention relates to a support for a detachable junction between at least two cables each one equipped with a connecting socket.

According to the invention, this support comprises:

a box (1,6,7,16) with a cover (17) for receiving the two joined sockets;

first stop means (9) to oppose the separation of the sockets;

a lock (19) with a key (22) mounted on the cover and a latch (24) mounted on the box, the lock being arranged for enabling the operation of the key and its release only when the latch cooperates with the said lock, whereas the latch can cooperate with the lock, only when the cover is in a closed position, and second stop means (31,32) arranged in such a way that in case at least one of the sockets is missing, it opposes the closing of the box.

Application to the cable support on works site.

9 Claims, 4 Drawing Sheets

SUPPORT FOR DETACHABLE JUNCTION BETWEEN CABLES

BACKGROUND OF THE INVENTION

Field of the Invention

The invention relates to a support for a detachable junction between at least two cables having each one a connection socket.

The problem to be solved by the present invention is to design a support enabling to guarantee that once the said support is closed by means of a lock each plug and each junction piece is present on the support and correctly linked and cannot be removed, either willingly or not without opening the lock. Furthermore, the closing of the support by means of the lock can be made possible only if each plug or junction piece is effectively present.

SUMMARY OF THE INVENTION

To this effect, the support according to the invention comprises a box having an opening arranged for receiving the two sockets joined together, first stop means provided on the box and cooperating with the sockets to oppose their separation, a cover to close the box, a keyed lock mounted on the cover and a latch mounted on the box or the other way round, the latch being arranged to allow the operation of the key and its release only when the latch cooperates with the lock, the mutual disposition of the lock and if the latch being such that this latter can cooperate with the lock only when the cover is in a position assuring the closing of the box, and the second stop means provided on the box, arranged for cooperating with the cover and with the sockets in such a way that in case when at least one of the sockets is missing these means oppose the closing of the box.

Advantageously, each junction between two cables comprises at least one junction and branch piece to cooperate with the sockets of these two cables and with that of a third branch cable the said first stop means being arranged to cooperating with the three sockets and the second stop means being arranged for cooperating with the three sockets and with the junction piece.

Advantageously the said second stop means comprise for each junction socket, an axial translation moving rod, flexibly biased towards a cooperation position with the cover, provided with a groove, and a blade spring crossed through by the rod and cooperating with the corresponding blade spring when located inside the box for moving this spring and releasing the rod.

In the case where the support is provided for receiving several junctions between cables in superinposed arrangement inside the box, the said rods have as many grooves distributed along their length as there are junctions, arranged for cooperating with as many blade springs.

In the case where the support is provided for receiving several junctions, each one comprising a multiplicity of junction pieces arranged end to end, the support has as many rods side by side as there are junction pieces.

Preferably, the lock or the latch are mounted on a flap hingedly fixed on the box and arranged for resting on the one or several junctions.

Preferably, the support comprises means for holding each cable outside and close to the box.

Preferably, the said holding means include for each cable, a jaw element mounted fixed on the support at right angles with the cable and a jaw element mounted movable in the face of the fixed jaw element, which can be moved closer to or away from the latter. Preferably, the jaw elements provided for cooperating with the branch cables are mounted on a structure tied to the support in such a way as to be capable of swivelling between a stowing position where it is flapped against the support and a service position where it is away therefrom, means being provided to lock the said structure in each one of the said positions.

BRIEF DESCRIPTION OF THE DRAWINGS

Other details and advantages of the invention will be disclosed from the following description, of some preferred embodiments, although non limitative, with reference to the attached drawings in which.

DESCRIPTION OF THE PREFERRED EMBODIMENT

Figures 1, 4, 5, 6:
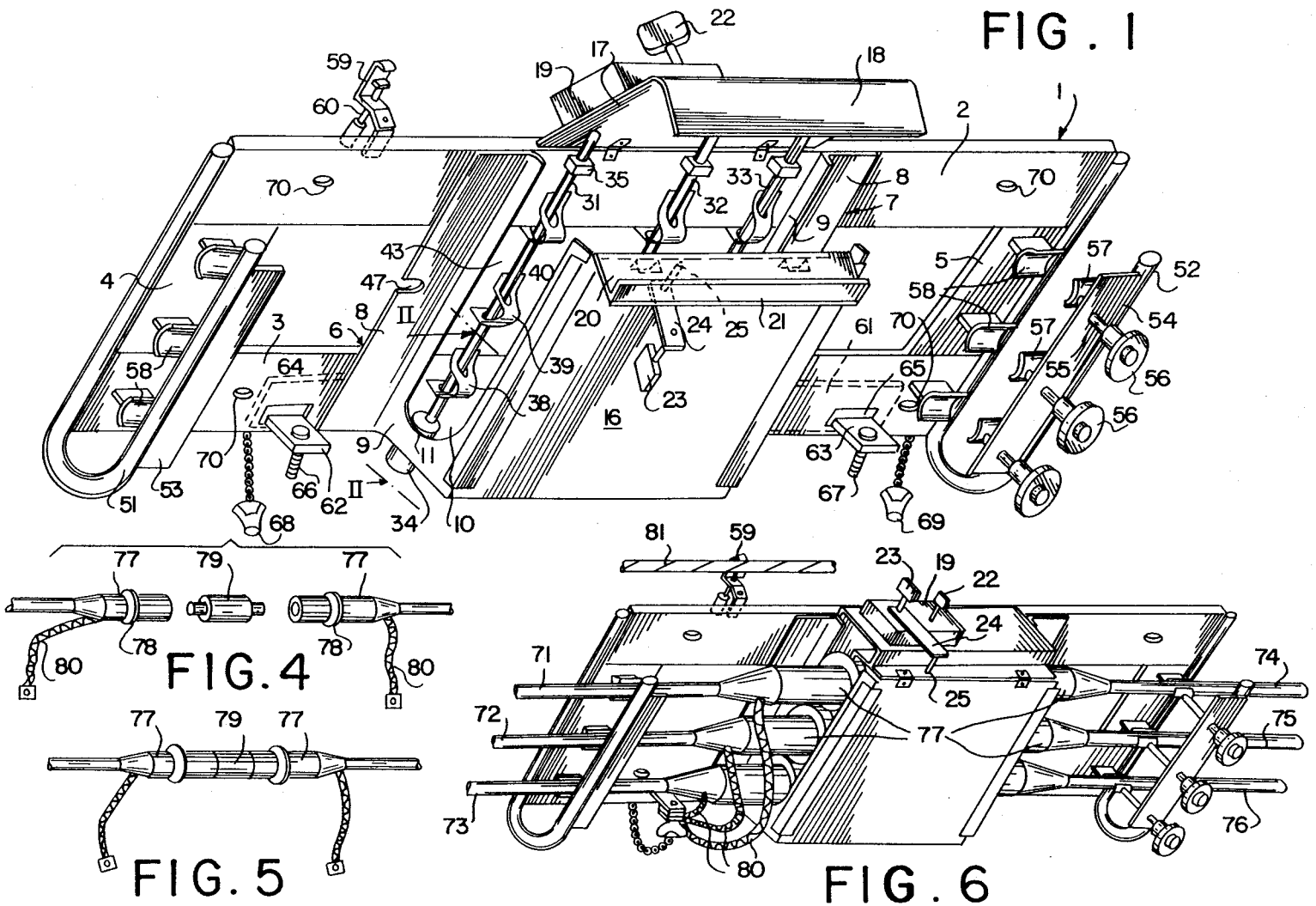
FIG. 1 is a front perspective view of a first embodiment of the support according to the invention, the support being open without cables fitted thereon.
FIG. 4 shows the junction means of two cables before assembly.
FIG. 5 shows these junction means after assembly.
FIG. 6 is similar to FIG. 1 and shows the support fitted with cables and closed.
Figure 3:
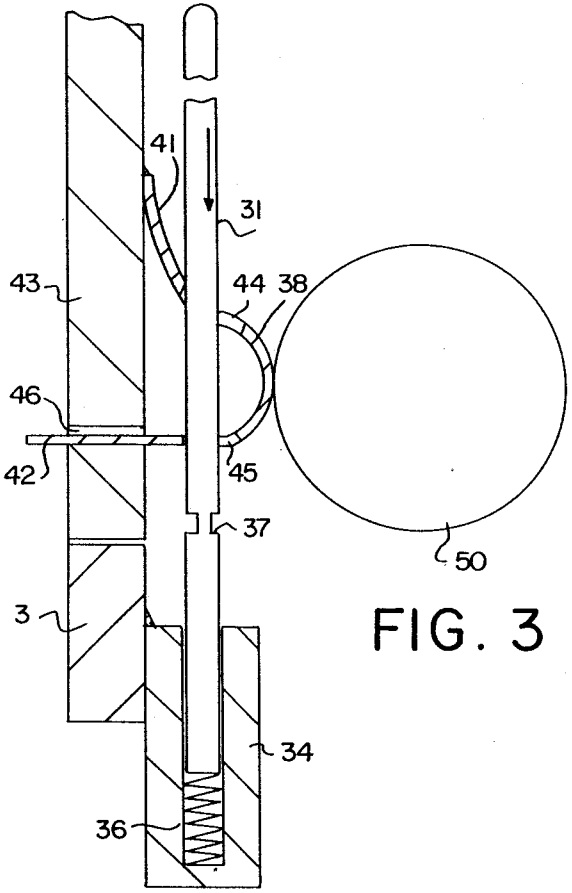
FIG. 3 is similar to FIG. 2 and shows the support with a cable junction arranged thereon.
Figure 2:
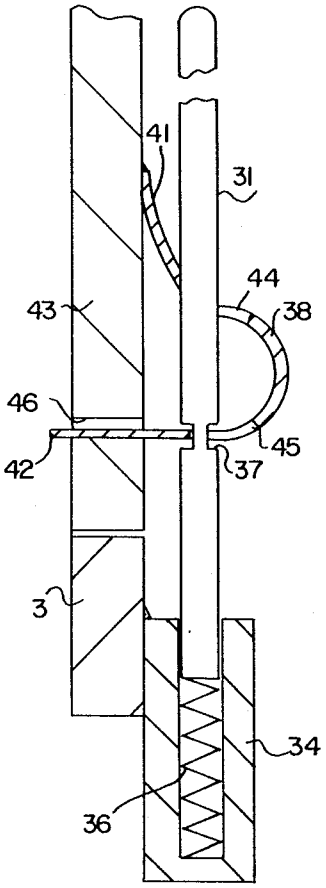
FIG. 2 is a partial cross-section according to the arrows II—II of FIG. 1.

The support shown on the FIGS. 1,2,3 and 6 is metallic, protected in an appropriate way against corrosion and comprises a rectangular frame 1 made of two longitudinal sides 2,3 linked by two transversal sides 4,5. Two angle irons 6,7 of L cross-section shape present two legs of which one leg 8 is transversally fixed on the longitudinal sides 2,3 of the frame 1 and the other leg 9 extends perpendicularly to the plane of frame 1. The leg 9 presents an elongated slot 10 extending longitudinally on the major part of the leg, with one open end and presenting a circular shaped bottom 11 at the other end.

A plate 16 extends between the two angle irons along their whole length and is fixed on the external longitundinal edges of the legs 9. At the bottom of the plate 16 close to the open end of the legs 9 a flap 20 is hingedly mounted along this side. The flap 20 comprises a flange 21 along its longitudinal side opposed to that linked to the plate 16. A cover 17 is hingedly mounted along one of its edges on the side 2 of the frame 1. It extends between the two angle irons 6,7 and presents a flange 18 provided for covering partially the plate 16.

A lock 19 is mounted on the external face of the cover 17. This lock, of a well known type, is integrated to a global safety system of a works site. It has a key 22 known as a "wander-key" and is arranged for cooperating with a latch 24 hingedly mounted on a rod 25, which is fixed itself perpendicularly on one face of the flap 20 opposed to that carrying the flange 21.

At the free end of the latch 24, a secondary key 23 is linked in such a way as to be able to move in translation over a determined path.

The introduction of the secondary key 23 in a specific hole of the lock 19 enables the rotation of the wander key 22 for locking the secondary key 23, then the release of the wander key. More specially a lock of the CASTELL-TRAYVOU firm, bearing the reference MOL 85, can be chosen.

Three rods 31,32,33 are mounted juxtaposed between the two angle irons 6,7 and parallel to these said angle irons. Each rod is maintained at its ends by means of two supports 34,35 in such a way as to be able to move in translation along its axis. It is biased in one direction by means of a helical spring 36 mounted in the support 34. The two supports 34,35 are fixed respectively on the sides 3 and 2 of the frame 1. Each rod presents three annular grooves 37 distributed along its length.

Three blade springs 38,39,40 are mounted on the junction cable support and perpendicularly to each rod 31,32,33. Each blade spring presents an end 41 fixed flat either on a plate 43 mounted on the frame between its longitudinal sides 2,3 and the iron angles 6,7 (for the springs 38,39) or on the longitudinal side 2 (for the springs 40). Each blade spring is formed in a loop shape which presents two holes 44,45 through which crosses the corresponding rod and ends by a free tip 42 crossing perpendicularly the plate 43 (springs 38,39) or the longitudinal side 2 of the frame 1 (spring 40) in a slit 46 fitted in these latter.

In the position where the helical spring 36 is released, the grooves 37 of each rod are placed at right angles with the holes 45 of the blade springs. The elasticity of the blade springs tends to move these latter away from the cable junction support, so that the edges of their holes 45 press against the bottom of the rod grooves 37: the rods 31,32,33 extend partly outside the frame 1 and therefore they cannot be moved in the direction of the support 34. It results therefrom that they oppose the closing of the cover 17 which abuts against their ends.

When a cable junction element 50 is, as defined further on, correctly arranged in the cable junction support, it pushes the corresponding blade spring 38 towards the cable junction support thus releasing the hole 45 of the blade spring from the groove 37 of the rod 31. This rod no longer abuts against the blade spring and can be moved towards the support 34, thus enabling the closing of the cover 17.

According to the requirements, it is possible to increase the number of blade springs to be adapted to a higher number of cables or to a higher number of junction elements, according to a matrix type extension.

Two bars 51,52, are fixed to the ends of the cable junction support. Each bar is U-shaped bent, one of the U flanges being fixed along one transversal side 4 or 5 of the frame 1, the other U flange supporting a plate 53,54. Three threaded rods 55 carrying at one end a handle 56 and at another end a moving jaw element 57, pivotally mounted on this end, are screwed transversally on each small plate 53,54.

Fixed jaw elements 58 are fastened to the transversal sides 45 of the frame 1, facing the moving jaw elements 57.

A copper flat bar 61 carrying on each one of its ends a transversal bracket 62,63 is fixed flatly and longitudinally on the longitudinal side face 3 of the frame 1 remote from the angle irons 6,7. Each one of the brackets 62,63 crosses through holes 64,65 provided in the side 3 of the frame 1, each one carrying a screw 66,67 fixed to the bracket.

A wing nut 68,69 is linked to the frame 1 by means of a chain, close to each bracket 62,63 to cooperate with the screws 66,67.

A claw 59 of a known type is fixed on the longitudinal side 2 of the frame 1, or on another point on account of the location of the support on the site, and enables the connection of this frame to an earth conductor. It comprises a screw 60 which can be operated for gripping this conductor and it is linked to the flat bar 61 by a plate of same type not shown on the figures.

Lastly, each one of the two longitudinal sides 23 of the frame 1, comprises two holes 70 enabling the fastening of the cable junction support on a wall. This fastening can also be assured by means of two elongated open grooves 47 provided on the legs 8 of the two angle irons 6,7 respectively.

The cable junction support described hereabove can be fixed on any horizontal, vertical or sloped surface, for instance a ground, a ceiling or a wall. More particularly it may be fixed on a sloped wall portion of a tunnel, in a position shown on FIG. 1, for supporting the supply cables of a tunnel digging engine. Such a support will be provided at each junction between two cable sections.

On FIG. 6, three single-pole insulated cables 71,72,73 represent the different phases of a three-phase supply network, and are connected to three other cables 74,75,76. Each cable end is equipped with an insulated movable socket 77, presenting an annular flange 78 (FIGS. 4 and 5). Two movable sockets are connected together by an insulated junction piece 79 presenting two end plugs. On the other hand each movable socket 77 is crossed through by an earth braid conductor 80.

Once the junctions between the different cables have been carried out, an operator lays down the junction between the cables 73,76 in the rounded bottom 11 of the elongated slot 10 of the angle iron 6,7. The length of this slot is smaller than the outside diameter of the annular flange 78 of the movable sockets 77 and the distance between the angle irons is slightly bigger than the distance between the two annular flanges 78 of a junction. The junction is thus locked in translation and the two sockets 77 are maintained against the junction piece 79, even if a pull effort is applied on the cables 73,76.

Further, the junction between the cables 72,75 is laid down on the preceding one, the flanges 78 of one junction resting on those of the other. Last, the third junction between the cables 71,74 is laid down on the preceding one.

In this situation, the bodies of the movable sockets 77 rest on the blade springs located at cross angles with the two rods 31 and 33 whereas the bodies of the junction pieces 79 rest on those located at cross angles to the rod 32. Then operator rotates the flap 20 in such a way as its flange 21 moves to be supported on the junction made between the cables 71 and 74, then he rotates the cover 17 on the flap 20 by exerting a pressure to bring the junctions to their stop position.

Then the operator rotates the latch 24 in order to introduce the second key 23 in the lock 19, to lock the said key by rotating the wander key 22 and by releasing this latter. One single wander key is available for an installation comprising a multiplicity of cable junction supports; it is thus released to carry out the locking of a next support or operations in a sub-station for the electrical supply of the installation. It must be observed that the latch 24 can be brought above the lock 19 only if the cover 17 has been completely flapped up to a position at right angles to the frame plane 1.

It will be noted that a wrong location or the lack of one only of the moving sockets 77 or junction pieces 79 causes the locking in a translation direction of a rod and prevents therefore the closing of the cover. For a whole installation comprising a multiplicity of junction supports linked in succession to one another, it will be observed that the wrong location or the missing of any one of the numerous junction elements is sufficient for preventing the locking of the support involved and thus to prevent the release of the key which is the prior condition for energizing the whole installation.

Thus, the operator brings the movable jaw elements 57 close to the fix jaw elements 58 to grip each cable close to the junction. The braid earth conductors 80 of the three cables of a section are fixed by their free ends to the screw 66 or 67 mounted on the frame 1, using the corresponding wing nut 68 or 69. On the other hand, an uninsulated earth conductor 81, tightened along the wall on which the support is fixed, is brought inside the earth claw 59 and the screw 60 of this latter is operated for gripping the conductor 81.

It will be noted that in the case where the three cables 71,72,73 are not to be linked to the three other cables 74,75,76 but constitute "dead ends", the operator has available three insulated end sockets each one having an annular flange.

DESCRIPTION OF ANOTHER EMBODIMENT

Figure 7:
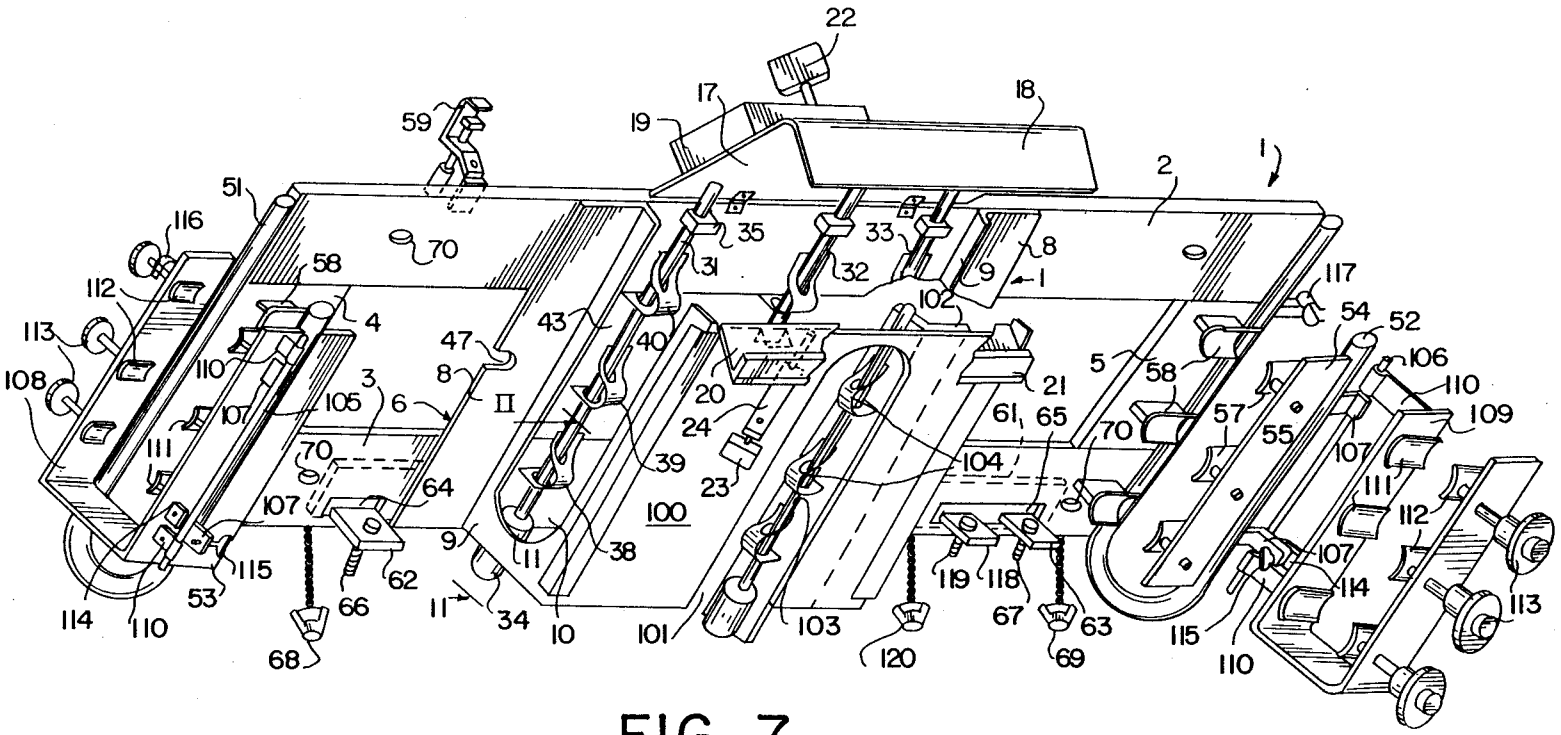
FIG. 7 is a front perspective view of a second embodiment of the support according to the invention, the support being open without cables fitted thereon.
Figure 9:
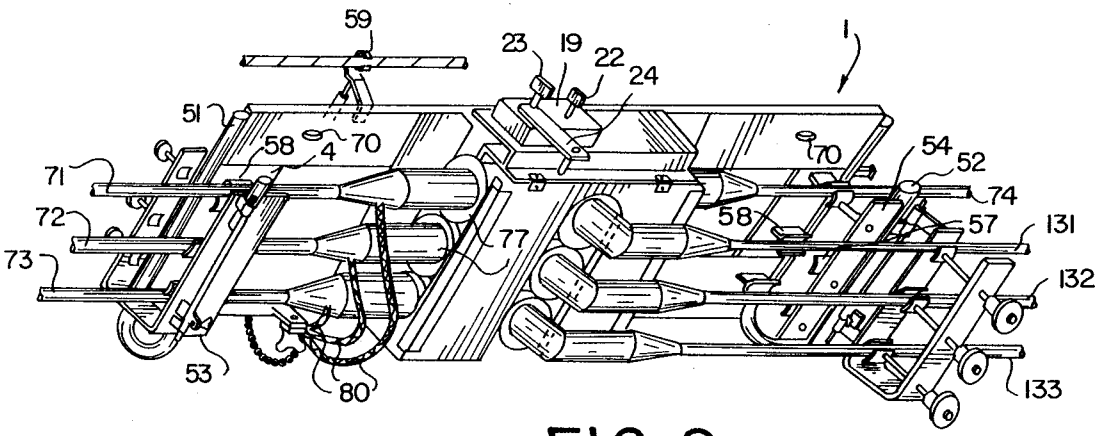
FIG. 9 shows the support of FIG. 7 fitted with cables and closed.

The support shown on the FIGS. 7 and 9 is another embodiment of the support described hereabove, and enables to carry out not only cable junction but simultaneously a cable branch. Same numeral references are assigned to the common pieces of the two types of supports.

Between the angle irons 6,7 of the junction and branch support, can be mounted detachable, either the solid plate 16 of the junction support (FIG. 1) in the case where only a junction is to be achieved, or a plate 100 (FIGS. 7 and 9) in the case where a junction and a branch are to be achieved. The plate 100 presents an elongated slot 101 exending almost completely therethrough with one open end. An angle iron 102 presents two legs of which one is fixed on the plate 100 in such a way as to extend along the elongated slot 101, and the other carries a rod 103, mounted in the same way as the rods 31 to 33 and arranged parallel to the said rods. Three blade springs 104 similar to the blade springs 38 to 40 are mounted along the rod 103. The plate 100 carries, on the other hand, the flap 20 used in the junction support of the FIG. 1.

A hinge axis 105,106 is fixed on the two bars 51,52 close to the small plates 53,54 and parallel to the said plates, by means of two brackets 107. A U-shaped jaw element support 108,109 is mounted pivotally on each hinge axis, by means of two brackets 110. It comprises two legs, one of which carries three fix jaw elements 111 and the other one three movable jaw elements 112 which can be moved by means of a handle 113.

Each jaw element support 108,109 carries a locking bracket 114, presenting a threaded bore arranged for cooperating with a wing screw 115, rotatively mounted on one of the brackets 107, in such a way as it can be locked in a position perpendicular to the plan of the frame 1 (support 109, FIG. 7). On the other hand, the frame 1 carries on each one of its transversal sides 4,5 a clip 116,117 arranged for receiving a rod of one of the movable jaw elements 112, of a jaw element support 108,109 when this latter is folded against the adjacent bar 51, 52 (support 108, FIG. 7).

Figure 8:
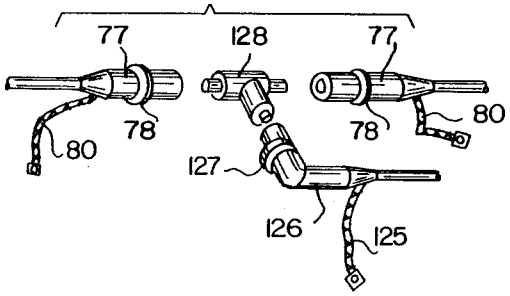
FIG. 8 shows the junction and branch means used in conjunction with the support of FIG. 7.

On the other hand, the flat bar 61 of the support of FIG. 7 carries an additional transversal bracket 118 provided with a screw 119 arranged for receiving a wing nut 120, thus enabling to collect the various earth braids 125 on the branch plugs 126 with the flat bar 61 (FIG. 8).

Each branch connection 126 is a socket and comprises an annular flange 127. It is connected to the two junction sockets 77 by a three way junction branch piece 128 presenting three end plugs.

In view of the mounting of the cables on the support of FIGS. 7 and 9, the junction between the cables 71 to 73 and the cables 74 to 76 is first carried out, then the connection between these latter cables and the branch cables 131 to 133. Once the plate 100 is removed and one of the jaw element supports 109 is unfolded, the cables are laid down successively in the support. Further, the plate 100 is slid between the angle irons 6,7, the annular flange 127 of the branch sockets cooperating with the plate 100 to hold them. The branch sockets 126 are laid against the blade springs 104, in such a way as the rod 103 can be pushed by the flap 20. The flap 20 and the cover 17 are then flapped for locking the second key 23 and the release of the wander key 22. The handles 56 are then actuated for gripping the junction cables 71 to 73 and 74 to 76 and the handles 113 of the jaw element support 109 are actuated for gripping the branch cables 131 to 133. Lastly, the earthing of the braids of the plugs 80,125 and of the frame 1 is achieved.

In the case where the operator has forgotten to unfold the jaw element support 109 before laying down the cables in the junction and branch support, the hinged axis 105,106 can be provided detachable and locked in translation direction by means of stop pins crossing through the brackets 107. Thus, the dismantling of the axis enables the removal of the jaw element supports to arrange it in its locking position.

In the case of the junction and branch support, it will be noted that the provision of the latch 24 linked to the moving plate 16 or 100 ensures that the operator will not forget to mount this plate.

What is claimed is:

1. A support for a detachable junction between at least two cables each one equipped with a connecting socket characterized in that it comprises:

a box (1,6,7,16) having a slot arranged for receiving the two joined sockets (77);

first stop means (9) provided on the box and cooperating with the sockets to oppose their separation;

a cover (17) to close the box;

a lock (19) and a key (22) mounted on the cover and a latch (24) mounted on the box or the other way round, the locking being arranged to enable the operation of the key and its release only when the latch cooperates with the lock, the disposition of the lock and of the latch being such as the said latch can cooperate with the lock only when the cover is in a position assuring the closing of the box, and second stop means (31,32) provided on the box, arranged for cooperating with the cover (17) and with the sockets (77), in such a way that in case one at least of the sockets is missing, these means oppose the closing of the box.

2. A support as claimed in claim 1, in which each junction between two cables comprises at least a junction and branch piece (128) for cooperating with the sockets of these two cables and with that (126) of a third branch cable (131), the said first stop means (9,100) being arranged for cooperating with the three sockets and the said second stop means being arranged for cooperating with the three sockets and the junction and branch piece.

3. A support as claimed in claim 1 or 2, in which the said second stop means comprises for each socket of the junction, a rod (31 to 33,103) movable in axial translation and flexibly biased towards a cooperating position with the cover, said rod being provided with a groove (37), and a blade spring (38 to 40, 104) crossed through by the rod and cooperating with the said groove for locking the rod, each socket cooperating with the corresponding blade spring when it is located inside the box for moving this spring and releasing the rod.

4. A support as claimed in claim 3, provided for receiving a multiplicity of cable junctions in a superimposed manner inside the box, the said rods (31 to 33, 103) comprising as many grooves distributed along their length as there are junctions, arranged for cooperating with as many blade springs as there are junctions.

5. A support as claimed in claim 4, provided for receiving a multiplicity of junctions each one comprising a multiplicity of junction pieces (77,79) arranged end to end, the support comprising as many juxtaposed rods (31 to 33) as there are junction pieces.

6. A support as claimed in claim 1, in which the latch (24) or the lock (19) is mounted on a flap (20) hingedly fixed on the cover and arranged to lie on the one or several junctions.

7. A support as claimed in claim 1, which comprises means (51,52,57,58) for holding each cable (71 to 76) outside and close to the box.

8. A support as claimed in claim 7 in which the said holding means comprises for each cable, a jaw element (58) mounted fixed on the support at cross angles with the cable and a jaw element (57) mounted movable in front of the fixed jaw element in order to be moved close to or away from the said fixed element.

9. A support as claimed in claim 2 or 8, in which the jaw elements (111,112) provided for cooperating with the branch cables (13 to 133) are mounted on a structure (108,109) linked to support in such a way that is able to swivel between a stowage position where it is flapped against the support and a service position where it is away from the said support, means (114,115,116,117) being provided for locking the said structure in each one of the said positions.

* * * * *

UNITED STATES PATENT AND TRADEMARK OFFICE

CERTIFICATE OF CORRECTION

PATENT NO. : 4,904,199

DATED : February 27, 1990

INVENTOR(S) : Ducassou

It is certified that error appears in the above-identified patent and that said Letters Patent is hereby corrected as shown below:

Col. 1, line 43, "to" should read --for--

Col. 4, line 13, "23" should read --2,3--

Col. 8, line 19, change "(13 to 133)" to --(131 to 133)--

Col. 8, line 20, before "support" insert --the--
and after "that" insert --it--.

Signed and Sealed this

Twenty-third Day of July, 1991

*Attest:*

*Attesting Officer*

HARRY F. MANBECK, JR.

*Commissioner of Patents and Trademarks*